US006354226B2

(12) United States Patent
Stecker

(10) Patent No.: US 6,354,226 B2
(45) Date of Patent: Mar. 12, 2002

(54) LIGHTWEIGHT TRUCK BOLSTER HAVING VARYING WALL THICKNESS RIBS

(75) Inventor: Todd W. Stecker, Canal Winchester, OH (US)

(73) Assignee: Buckeye Steel Castings Company, Columbus, OH (US)

( * ) Notice: Subject to any disclaimer, the term of this patent is extended or adjusted under 35 U.S.C. 154(b) by 0 days.

(21) Appl. No.: 09/797,105

(22) Filed: Mar. 1, 2001

Related U.S. Application Data

(63) Continuation of application No. 09/238,248, filed on Jan. 27, 1999, now Pat. No. 6,196,134.
(60) Provisional application No. 60/073,240, filed on Jan. 30, 1998.

(51) Int. Cl.[7] ..... B61F 5/04
(52) U.S. Cl. ..... 105/226; 105/228; 105/230
(58) Field of Search ..... 105/226, 230, 105/197.05, 228, 227, 190.2; 213/75 R, 62 A, 60, 61

(56) References Cited

U.S. PATENT DOCUMENTS 816,010 A * 3/1906 Goodwin ..... 213/75 R
1,031,276 A * 7/1912 Lamont ..... 213/75 R
4,196,672 A * 4/1980 Bullock ..... 105/230
4,342,266 A 8/1982 Cooley
4,370,933 A * 2/1983 Mulcahy ..... 105/197 DB
5,111,753 A * 5/1992 Zigler et al. ..... 105/230
5,138,954 A * 8/1992 Mulcahy ..... 105/199.3
5,139,159 A * 8/1992 Daugherty, Jr. et al. .. 213/75 R
5,481,986 A 1/1996 Spencer et al.
5,718,177 A * 2/1998 Wronkiewicz et al. .. 105/206.1
5,809,899 A * 9/1998 Kaufhold et al. ..... 105/199.4

* cited by examiner

*Primary Examiner*—S. Joseph Morano
*Assistant Examiner*—Frantz F. Jules
(74) *Attorney, Agent, or Firm*—Banner & Witcoff, Ltd.

(57) ABSTRACT

There is disclosed a light weight truck bolster for railway car trucks. Metal has been removed in the compression and tension members of the bolster near the center bowl. One longitudinal rib is located in each end of the bolster arms and a pair of transversely extending vertical ribs are located on opposing sides of the center bowl and extend from the tension member to the compression member. The disclosed light weight truck bolster satisfies the Association of American Railroads ("A.A.R.") design qualifications for truck bolsters while weighing significantly less than traditional truck bolsters.

19 Claims, 3 Drawing Sheets

LIGHTWEIGHT TRUCK BOLSTER HAVING VARYING WALL THICKNESS RIBS

This application claims the benefit of U.S. Provisional Application No. 60/073,240, filed Jan. 30, 1998, and is a continuation application of U.S. application Ser. No. 09/238,248, filed Jan. 27, 1999, now U.S. Pat. No. 6,196,134, the entire disclosure of which is incorporated by reference.

BACKGROUND OF THE INVENTION

1. Field of the Invention

The present invention relates generally to railcar trucks and more particularly to a lightweight railcar truck bolster.

2. Description of the Related Art

Railcar trucks are the wheeled vehicles that ride on the tracks and support the railcar body. Two trucks are normally used beneath each car body. Each truck includes wheel sets which includes two wheels spaced transversely from each other and joined by a transversely extending axle. Journal bearings are pressed onto each of the axle. Transversely spaced side frames are supported on the wheel sets. The side frames are longitudinally elongated and define longitudinally spaced, downwardly opening pedestal jaws. Bearing adapters are mounted in the jaws and the adapters rotatably receive the wheel set journal bearings. The wheel sets and side frames are mounted together by the bearing adapters.

Transversely extending between each side frame is a truck bolster. The truck bolster includes a center bowl and two opposed, elongated bolster arms that extend transversely outward from beneath the center bowl. The arms and the bolster overall, are formed of a top plate, also known as a compression member, a bottom plate, also known as a tension member, and two upright structural or side walls. The bolster arms extend outward a length such that in service, the bolster arms extend through bolster arm openings in the side frames. The truck bolster is mounted on helical springs which are also mounted in the bolster arm openings and supported on the side frames. The helical springs support the weight of the railcar and payload and cushion the shock caused by uneven railroad track.

The Association of American Railroads ("A.A.R.") sets forth structural requirements for truck bolsters. These requirements include the truck bolster being strong enough to support the weight of the railcar and its payload and also exhibit fatigue resistant capabilities for extended service of the bolster. Because the railcar truck bolsters must exhibit high strength, truck bolsters are conventionally made of cast steel and contribute a significant part of the total weight of the railway car. In the rail line shipping industry, weight limits are placed on shippers of goods for preserving the safety and conditions of the track. Consequently, the quantity of goods that may be placed in or on a railcar is affected by the weight of the railcar body, the trucks and other railcar components. Thus, a reduction in the weight of the railcars, including the truck bolster, will result in an increase in the total capacity of goods shipped by a rail line owner. Therefore, it is highly desirable to reduce the weight of the truck bolster while at the same time maintaining the strength and fatigue resistance capabilities of the bolster.

SUMMARY OF THE INVENTION

Accordingly, an object of the present invention is to reduce the weight of a railway car by reducing the overall weight of the truck bolster. It is another object of the invention to reduce the weight of the truck bolster without a decrease in strength or fatigue resistance.

Briefly, the present invention involves removing metal from the compression and tension members of the truck bolster and locating a pair of vertical ribs on opposing sides of the bolster center bowl. The vertical ribs extend from the tension member to the compression member. The compression member has a wall thickness that is thinner than conventional bolsters near the center bowl and gradually increases in thickness from the center bowl to the ends of the bolster arms. Likewise, the tension member has a wall thickness that is thinner near the center of the bolster and which gradually increases in thickness toward the ends of the bolster arms. Both the tension and compression members are continuous without lightener holes. To compensate for the loss of material and resulting strength in the compression and tension members, the transversely extending vertical ribs are added on opposing sides of the center bowl to provide the required structural strength to the bolster. Significantly, the disclosed bolster is lighter than conventional truck bolsters, thereby creating an increase in the total capacity of goods that can be shipped by rail line owners. Specifically, the weight of the disclosed bolster has been reduced by over 230 pounds, translating into a weight reduction of over 46,000 pounds for a typical 100-car train. This significant weight reduction, in turn, translates into a significant increase in goods which may be shipped by rail line owners.

In addition, the disclosed light weight truck bolster is cast from a one-piece bolster core which offers several manufacturing advantages. Traditionally, three to five core pieces were used which led to problems during the pouring process, such as, core shifting. Core shifting, in turn, led to dimensional inconsistencies and greater wall thicknesses which, consequently, led to an increase in the weight of the bolster. These problems are eliminated with a one-piece core. Also with a one-piece core, the bolster wall thickness can be reduced without the possibility of multi-core shifting which, in the past, has created walls that were too thin. Moreover, in addition to the increased manufacturing efficiency with a one-piece core, chaplets which typically were used to support multi-cores are no longer needed to support the cores. Instead, the mold supports the one-piece core. Without the use of chaplets, associated problems, such as, the creation of stress concentrations and removal of chaplet scars in finishing are eliminated. Moreover, significant savings in the costs associated with finishing the bolsters are realized.

The full range of objects, aspects and advantages of the invention are only appreciated by a full reading of this specification and a full understanding of the invention. Therefore, to complete this specification, a detailed description of the invention and the preferred embodiments follow, after a brief description of the drawings.

BRIEF DESCRIPTION OF THE DRAWINGS

The preferred embodiments of the invention will be described in relation to the accompanying drawings. In the drawings, the following figures have the following general nature.

In the accompanying drawings, like reference numbers are used throughout the various figures for identical structures.

DESCRIPTION OF THE PREFERRED EMBODIMENTS

Figure 1:
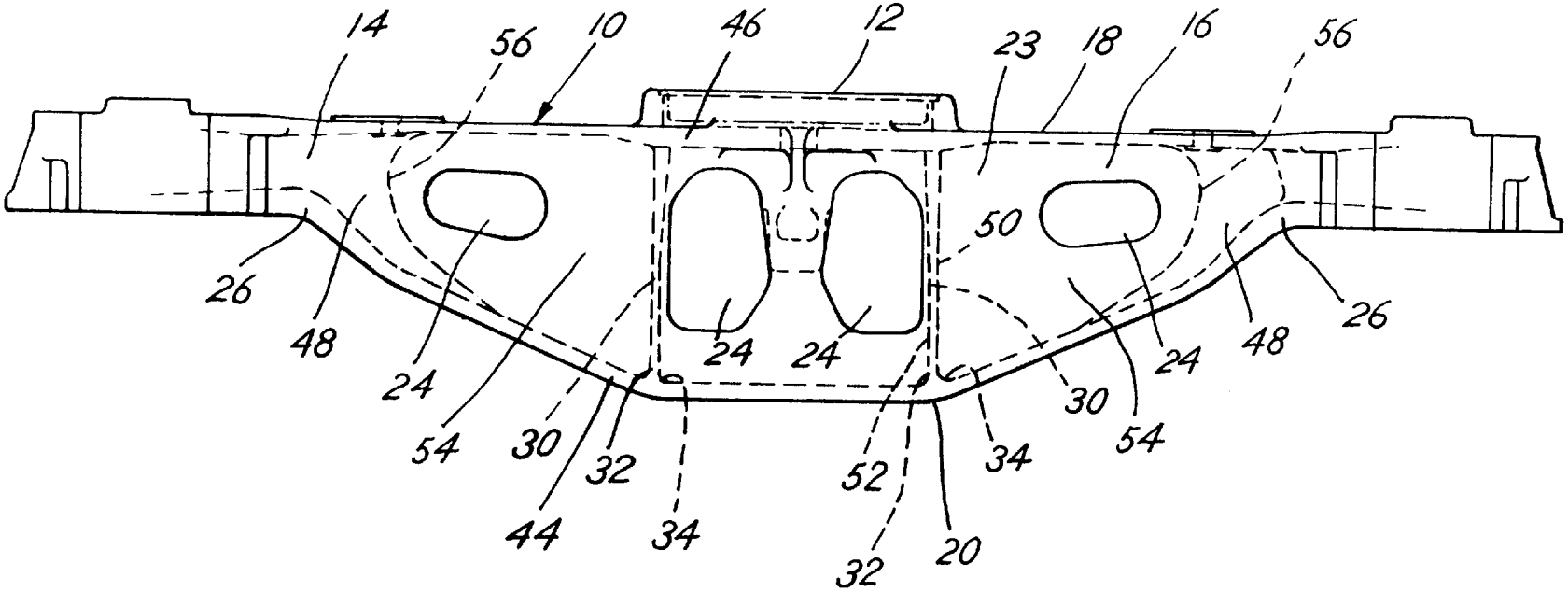
FIG. 1 is a side elevation view of the truck bolster of the present invention.
Figure 2:
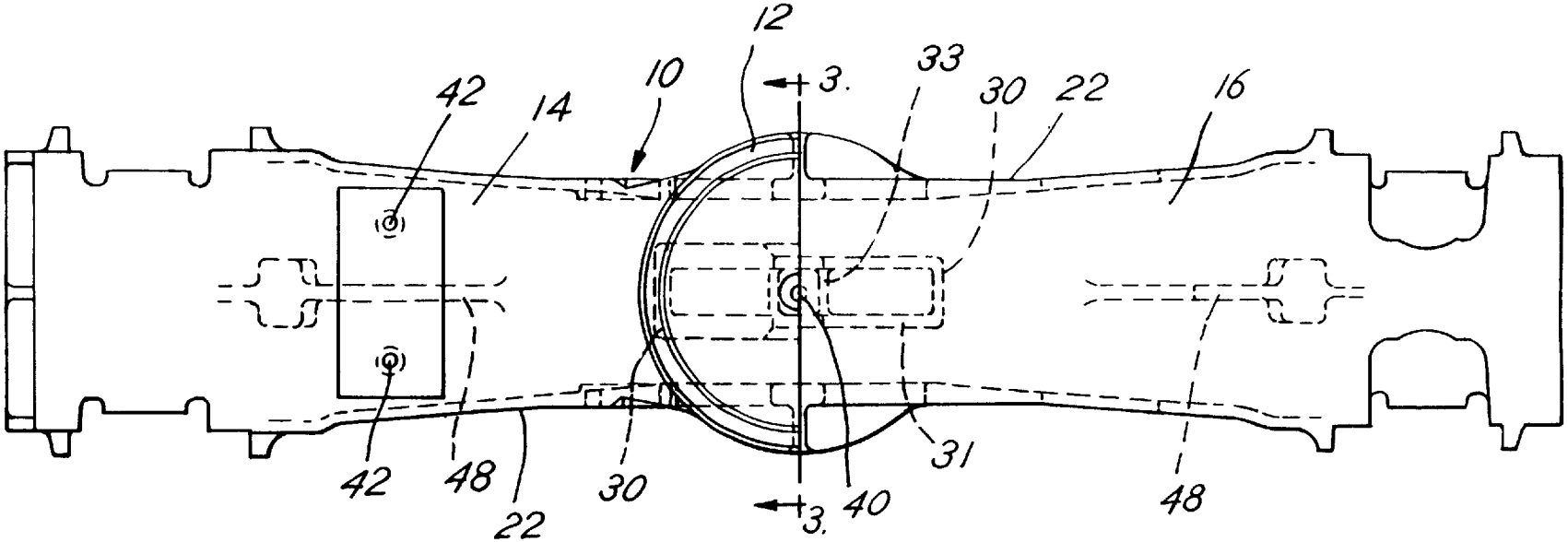
FIG. 2 is a half-top plan view and a half-bottom plan view of the invention of FIG. 1.
Figure 3:
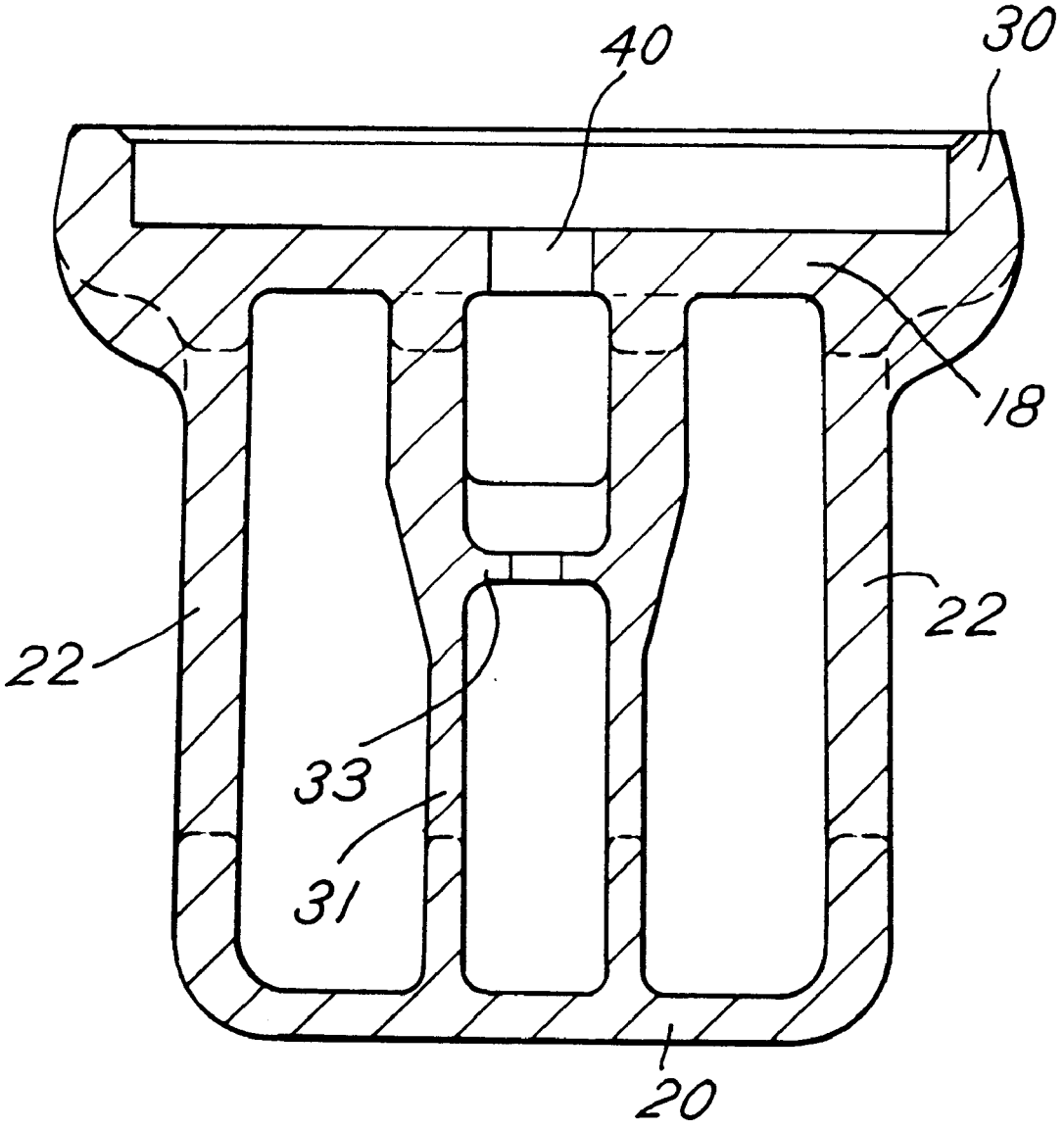
FIG. 3 is a cross-section view of the invention of FIG. 2 taken along lines 3—3.

Referring to FIGS. 1–3, there is depicted a preferred embodiment of a light weight truck bolster that meets the A.A.R. structural qualifications for truck bolsters while weighing significantly less than traditional truck bolsters. The preferred truck bolster 10 comprises a center bowl 12, two opposed, elongated bolster arms 14 and 16 that extend transversely outward from beneath the center bowl. The arms and the bolster overall, are formed of a compression member 18, a tension member 20, and two upright structural or side walls 22. The compression and tension members, and side walls form and define a bolster cavity 23. To facilitate manufacture, reduce weight and enable mounting brakes and side bearings, lightener holes 24 are located within the side walls 22 on each bolster arm 14 and 16. The bolster also has a center bore 40 for receiving a king pin to connect the truck to the railcar body. Bolt holes 42 are located near the ends of the bolster arms for mounting side bearings to the bolsters.

In a preferred embodiment of the tension and compression members, the wall thickness of each has been reduced. Specifically, metal has been removed in the tension member 20 below the center bowl 12 and generally along the entire compression member. As shown in FIG. 1, the preferred thickness of the tension member wall 44 has been reduced to approximately 15/16 of an inch. This preferred thickness is constant below the center bowl region and gradually increases from the center bowl region toward the end of the bolster arms 14 and 16 with the maximum thickness being over the turn 26 of the spring seat, a location of high stress concentration. At this turn, the thickness increases to a preferable 1½ inches. The preferred thickness of the tension member then gradually decreases toward the end of the bolster arms 14 and 16 to approximately 1 1/16 inches.

Metal has also been removed in the compression member 18 in the area below the center bowl 12. The preferred thickness of the compression member wall 46 immediately below the center bowl has been reduced to approximately 1¼ inches. The preferred thickness has been further reduced in the bolster arms to approximately ¾ of an inch. The preferred thickness remains constant along the bolster arms with a gradual increase in thickness toward the turn 26 of the spring seat. At this turn, the thickness increases to a preferable 1 3/16 inches. Again, the preferred thickness of the compression wall 46 gradually decreases toward the end of the bolster arms 14 and 16 to approximately ⅞ of an inch. Variations to the above preferred thicknesses of the tension and compression members are contemplated and considered within the scope of the present invention.

Also in a preferred embodiment of the tension and compression members, lightener holes previously in the tension and compression members have been removed. With the removal of the lightener holes, previous metal flow problems, such as the creation of vertices and stress concentrations, are eliminated. The king pin hole and side bearing bolt holes on the compression member are retained.

In traditional bolsters, two longitudinal ribs were needed and were located within each bolster arm above and below the lightener holes in the tension and compression members, respectively, and running uninterrupted the entire length of the bolster arm. Also with traditional bolsters, transverse ribs were located below the center bowl extending upward approximately 5 inches from the inside of the tension member. A preferred bolster 10 has only one longitudinal rib 48 in each bolster arm end and a transverse rib 30 on each side of the center bowl 12 that extends the full height of the side walls 22, from the tension member 20 to the compression member 18. The transverse ribs 30 located on each side of the center bowl are connected by a pair of longitudinal rib connecting walls 31. As shown in FIG. 3, the rib walls 31 increase in thickness from the tension member 20 to the compression member 18. Structural cross ribs 33 transverse the rib walls 31 and are located between the transverse ribs 30 and provide structural support for the rib walls 31.

The longitudinal rib 48 extends from the tension member 20 to the compression member 18 and the free edge defines a curvature 56. The curvature 56 allows the rib 48 to form into the tension and compression member eliminating the sharp transition between the rib 48 and the members 18 and 20. The gradual transition of the rib 48 into the compression and tension members reduces the potential stress concentrations that would typically occur at sharp transitions between adjoining cast members.

At the junction 32 where the transverse rib 30 forms with the tension member 20, the rib wall thickness is reduced and small radii 34 are formed between the rib wall and the tension member 20 to prevent shrink in the casting at that junction. The transverse rib 30 has opposite faces 50 and 52. The face 50 throughout the entire height of the wall, is generally perpendicular to the plane of the compression member. The face 52 throughout the entire height of the wall is angled from the tension member to the compression member. This angled face of the rib wall results in the transverse rib 30 having an increase in wall thickness from the junction 32 to the point at which the rib 30 joins with the compression member 18.

The preferred bolster 10 with the longitudinal ribs 48 located near the bolster arm ends and the transversely extending ribs 30 located near the center bowl creates bolster arms that define an empty hollow space 54, that is, without metal support ribs or gussets in the bolster arms. The empty hollow space 54 is formed by the compression and tension members, the side walls, and the transverse and longitudinal ribs. With the exception of the aforementioned improvements to the truck bolster, the remainder of the bolster is conventional.

Significantly, with the preferred bolster 10, a one-piece bolster core is used to manufacture the bolster casting. Traditionally, three to five core pieces were used which led to problems during the pouring process, such as, core shifting, which, in turn, led to casting flaws, offsets and dimensional inconsistencies. Stress concentrations develop at these casting flaws and offsets and are typically a primary reason for metal fatigue. With a one-piece core, the bolster is significantly easier to manufacture, resulting in an increase in production efficiency, and the problems associated with core shifting and resulting stress concentrations are eliminated. In addition, with the one-piece core, no chaplets are needed to support the core. Instead, the mold supports the core eliminating problems such as stress concentrations around the chaplet and chaplet scars or fusion of the chaplets to the casting. In addition, finishing of the chaplet scars is no longer required.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. A railway truck bolster comprising:

a compression member defining a center bowl, a tension member connected to the compression member by a pair of side walls, the compression member, tension member, and side walls defining bolster arms extending outwardly from the center bowl, the bolster arms terminating at a first end and a second end, a pair of transverse vertical ribs positioned on opposing sides of the center bowl between the center bowl and the first and second ends, the transverse vertical ribs extending from the tension member to the compression member, the transverse vertical ribs defining a rib wall that increases in thickness from the tension member to the compression member, and a pair of longitudinal vertical ribs extending between the pair of transverse vertical ribs.

2. The truck bolster of claim 1 wherein a longitudinal rib is located at each end of the bolster arm, the longitudinal rib extending from the tension member to the compression member.

3. The truck bolster of claim 2 wherein a generally hollow space is formed in the bolster arms between the compression and tension members, the side walls, the transverse vertical rib and the longitudinal rib.

4. The truck bolster of claim 2 wherein the longitudinal rib defines a free edge, the free edge defines a curvature extending from the tension member to the compression member.

5. The truck bolster of claim 1 wherein the compression member defines a king pin hole and side bearing bolt holes, the compression member is a solid wall having no lightener holes except for the king pin hole and the side bearing bolt holes.

6. The truck bolster of claim 1 wherein the tension member is a solid wall having no lightener holes.

7. The truck bolster of claim 1 wherein the side walls define a plurality of openings.

8. The railway truck bolster comprising:

a compression member defining a center bowl, a tension member connected to the compression member by a pair of side walls, the compression member, tension member, and side walls defining bolster arms extending outward from the center bowl, the bolster arms terminating at a first end and a second end, the tension member having a wall thickness that gradually increases near the first and second ends of the bolster arms, a first longitudinal rib located near the first end of the bolster arm, a second longitudinal rib located near the second end of the bolster arm, a pair of transverse vertical ribs positioned on opposing sides of the center bowl between the center bowl and the first and second ends, the transverse vertical ribs extending from the tension member to the compression member, and a generally hollow space formed in the bolster arms between the compression and tension members, the side walls, the transverse vertical rib and the longitudinal rib.

9. The truck bolster of claim 8 wherein the longitudinal ribs extend from the tension member to the compression member.

10. The truck bolster of claim 8 wherein the compression member defines a king pin hole and side bearing bolt holes, the compression member is a solid wall having no lightner holes except for the king pin hole and the side bearing bolt holes.

11. The truck bolster of claim 8 wherein the tension member is a solid wall having no lightener holes.

12. The truck bolster of claim 8 wherein the side walls define a plurality of openings.

13. The truck bolster of claim 8 wherein the longitudinal ribs define a free edge, the free edge defines a curvature extending from the tension member to the compression member.

14. The truck bolster of claim 8 wherein the transverse vertical ribs define a rib wall that increases in thickness from the tension member to the compression member.

15. A railway truck bolster comprising:

a compression member defining a center bowl, a tension member connected to the compression member by a pair of side walls, the compression member, tension member, and side walls defining bolster arms extending outward from the center bowl, the bolster arms terminating at a first end and a second end, a pair of transverse vertical ribs positioned on opposing sides of the center bowl between the center bowl and the first and second ends, the transverse vertical ribs extending from the tension member to the compression member, the transverse vertical ribs defining a rib wall that increases in thickness from the tension member to the compression member, a first longitudinal rib located near the first end of the bolster arm, a second longitudinal rib located near the second end of the bolster arm, and a generally hollow space formed in the bolster arms between the compression and tension members, the side walls, the transverse vertical rib and the longitudinal rib.

16. The truck bolster of claim 15 wherein each of the longitudinal ribs define a free edge, the free edge defines a curvature extending from the tension member to the compression member.

17. The truck bolster of claim 15 wherein the compression member defines a king pin hole and side bearing bolt holes, the compression member is a solid wall having no lightener holes except for the king pin hole and the side bearing bolt holes.

18. The truck bolster of claim 15 wherein the tension member is a solid wall having no lightener holes.

19. The truck bolster of claim 15 wherein the side walls define a plurality of openings.

* * * * *